US007703707B2

(12) United States Patent
Yasukawa et al.

(10) Patent No.: US 7,703,707 B2
(45) Date of Patent: Apr. 27, 2010

(54) FUEL INJECTOR

(75) Inventors: Yoshihito Yasukawa, Hitachinaka (JP); Yoshio Okamoto, Omitama (JP); Hiroshi Yamada, Isesaki (JP); Nobuaki Kobayashi, Maebashi (JP); Satoshi Hashimoto, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 197 days.

(21) Appl. No.: 11/949,994

(22) Filed: Dec. 4, 2007

(65) Prior Publication Data

US 2008/0142623 A1 Jun. 19, 2008

(30) Foreign Application Priority Data

Dec. 19, 2006 (JP) ..... 2006-341152

(51) Int. Cl.
*F02M 61/10* (2006.01)

(52) U.S. Cl. ..... 239/533.11; 239/533.12; 239/585.1; 239/585.5; 239/590.5; 239/900

(58) Field of Classification Search ..... 239/533.11, 239/533.12, 584, 585.1, 585.4, 585.5, 590, 239/590.5, 900

See application file for complete search history.

(56) References Cited

U.S. PATENT DOCUMENTS

| | | | | |
|---|---|---|---|---|
| 4,651,931 | A * | 3/1987 | Hans et al. | 239/533.11 |
| 5,492,277 | A * | 2/1996 | Tani et al. | 239/585.5 |
| 5,518,185 | A | 5/1996 | Takeda et al. | |
| 6,170,764 | B1 * | 1/2001 | Muller et al. | 239/590 |
| 6,779,743 | B2 | 8/2004 | Kitamura | |
| 6,886,760 | B2 * | 5/2005 | Potz et al. | 239/533.11 |
| 7,021,570 | B2 | 4/2006 | Tani et al. | |
| 2004/0069873 | A1 * | 4/2004 | Tani et al. | 239/533.2 |

FOREIGN PATENT DOCUMENTS

| | | | |
|---|---|---|---|
| JP | 6-264843 | A | 9/1994 |
| JP | 11-13597 | A | 1/1999 |
| JP | 11-200998 | A | 7/1999 |
| JP | 2004-19610 | | 1/2004 |
| JP | 2004-68788 | | 3/2004 |
| JP | 2006-513371 | A | 4/2006 |
| WO | WO 2004/063554 | A2 | 7/2004 |

OTHER PUBLICATIONS

Japanese Patent Office Action dated Dec. 9, 22009 with an English translation (Six (6) pages).

* cited by examiner

*Primary Examiner*—Steven J Ganey
(74) *Attorney, Agent, or Firm*—Crowell & Moring LLP

(57) ABSTRACT

In the valve, fuel, flowing down as a valve side flow along the side of the valve, further flows down toward an orifice plate through a fuel path which closes and opens upon forward and backward movement of the valve, and is injected as a mist from each orifice. The valve moves forward and backward by sliding on a valve surrounding portion through a guide portion constituted by plural sliding guides arranged between the valve and valve surrounding portion. Since the sliding guides are tapered from the valve to the surrounding portion, the side flow from the guide portion has a flow velocity distribution biased toward the surrounding portion.

4 Claims, 6 Drawing Sheets

FUEL INJECTOR

CLAIM OF PRIORITY

The present application claims priority from Japanese application serial no. 2006-341152, filed on Dec. 19, 2006, the content of which are hereby incorporated by reference into this application.

BACKGROUND OF THE INVENTION

1. Field of the Invention

The present invention relates to a fuel injector for supplying fuel into an internal combustion engine and more particularly to an orifice type fuel injector which injects fuel through orifices in an orifice plate.

2. Description of Related Art

In recent years, automobile emission gas regulations have been tightened and demand for reduction of harmful hydrocarbon components in emission gas from internal combustion engines has been growing. For reduction of hydrocarbon components in emission gas, it is useful to encourage atomization of fuel injected as a mist from a fuel injector mounted in a vehicle's internal combustion engine and it is also useful to suppress adhesion of fuel to the wall surface of the intake pipe by accurately orienting a fuel injection from the fuel injector toward a target point (an intake valve).

An orifice type fuel injector is available as a fuel injector which promotes atomization of injected fuel and improves the directivity of fuel injection. The orifice type fuel injector, which includes an orifice plate with orifices therein, causes the fuel to flow horizontally along the orifice plate and leads the horizontally flowing fuel into the orifices from which it is injected. Through this process, atomization of injected fuel is encouraged and a high directivity of fuel injection is achieved (for example, see Patent Document 1 and Patent Document 2).

The orifice type fuel injector has a problem that fuel injections from the plural orifices in the orifice plate and fuel atomization conditions are not uniform. This problem of nonuniformity is attributable to a guide portion which guides forward/backward movement of the valve to control fuel injections from the orifice plate.

The fuel injected from orifices in the orifice plate is first supplied as a valve side flow, a flow along the side of the valve. The fuel in this valve side flow passes through a fuel path which opens or closes as the valve moves backward and forward to leave or touch a nozzle body etc., and then flows down to the orifice plate and spouts out through the orifices. In this fuel supply structure, the valve is designed to move backward and forward to open or close the valve by sliding on a valve surrounding portion provided so as to surround the valve; and sliding of the valve is done through a guide portion formed by arranging plural sliding guides between the valve and the valve surrounding portion.

The fuel flowing down along the valve side as a valve side flow passes through the guide portion while it is flowing down. In this process, under the influence of the sliding guides, an eddy of the fuel occurs beneath the guide portion and under the influence of this eddy, nonuniformity in the flow velocity of the fuel flowing down toward the orifice plate occurs in the valve circumferential direction. If, as a result of this nonuniform flow velocity in the valve circumferential direction, the flow velocity of fuel injected from the orifices in the orifice plate should differ from hole to hole, fuel injections and fuel atomization conditions would be not uniform.

However, the problem of flow velocity nonuniformity in the valve circumferential direction attributable to the sliding guides normally occurs as a static flow velocity distribution in which high and low flow velocities are distributed depending on the arrangement of sliding guides. Therefore, the influence of flow velocity nonuniformity in the valve circumferential direction can be reduced by adopting a structure which matches the static flow velocity distribution. Patent Document 3 discloses a technique which takes advantage of this finding to make fuel injections from orifices and fuel atomization conditions uniform.

In the technique disclosed in Patent Document 3, unlike the conventional structure having a guide portion (sliding guide) on the valve, a guide portion is provided in a valve seat and plural orifices in a jet adjusting plate (orifice plate) are arranged in a way to match the arrangement of guides. In other words, the guide portion is located in the valve seat fixed with respect to the jet adjusting plate and thus the positional relation between the guides and the orifices in the jet adjusting plate is fixed, thereby offering a structure which matches the above static flow velocity distribution; and furthermore given this fixed positional relation, orifices are so arranged as to match the arrangement of guides, thereby offering another structure which matches the static flow velocity distribution. This reduces the influence of flow velocity nonuniformity in the valve circumferential direction.

Patent Document 1: Japanese Patent Laid-open No. Hei 11(1999)-200998

Patent Document 2: Japanese Patent Laid-open No. 2006-513371

Patent Document 3: Japanese Patent No. 3134813

BRIEF SUMMARY OF THE INVENTION

The technique described in Patent Document 3 which takes advantage of static flow velocity distribution in relation to flow velocity nonuniformity in the valve circumferential direction is useful to some extent for the purpose of preventing the influence of fuel flow velocity nonuniformity in the valve circumferential direction attributable to sliding guides, on fuel injections through orifices. However, this technique assumes that the flow velocity of fuel flowing down to orifices is not uniform in the valve circumferential direction, which means that some influence thereof is unavoidable and fuel injections and fuel atomization conditions are not uniformalized satisfactorily.

The conventional technique as described in Patent Document 3 necessitates sliding guides (guide portion) to be located in the valve surrounding portion (valve seat), which is a restrictive factor for the manufacture of a fuel injector. Specifically, from the viewpoint of machinability, mounting sliding guides on a valve surrounding portion which is usually thin-walled is more difficult than mounting sliding guides on a sufficiently thick valve and the machining process involves intricate machining work. In intricate machining work, machining errors are more likely to occur, which may result in less uniform fuel injections or fuel atomization conditions.

Also, in the technique as described in Patent Document 3, it is necessary to arrange orifices in a way to match the arrangement of sliding guides, which limits the degree of freedom in the arrangement of orifices.

The present invention has been made in view of the above circumstances and is intended to provide a fuel injector with sliding guides which effectively avoids the influence of the sliding guides on fuel injections from orifices.

A fuel injector in the present invention comprises a valve, a fuel path which closes and opens as the valve moves forward and backward, an orifice plate, an orifice made in the orifice plate, a valve surrounding portion provided around the valve and a guide portion constituted by a plurality of sliding guides arranged between the valve and the valve surrounding portion, the sliding guides having a shape for making a biased flow velocity distribution, wherein fuel, which flows down as a valve side flow along a side of the valve and further flows down through the fuel path toward the orifice plate and is injected as a mist from the orifice, generates a flow velocity distribution biased toward the valve surrounding portion when flowing along the side of the valve.

DETAILED DESCRIPTION OF THE INVENTION

Figure 1:
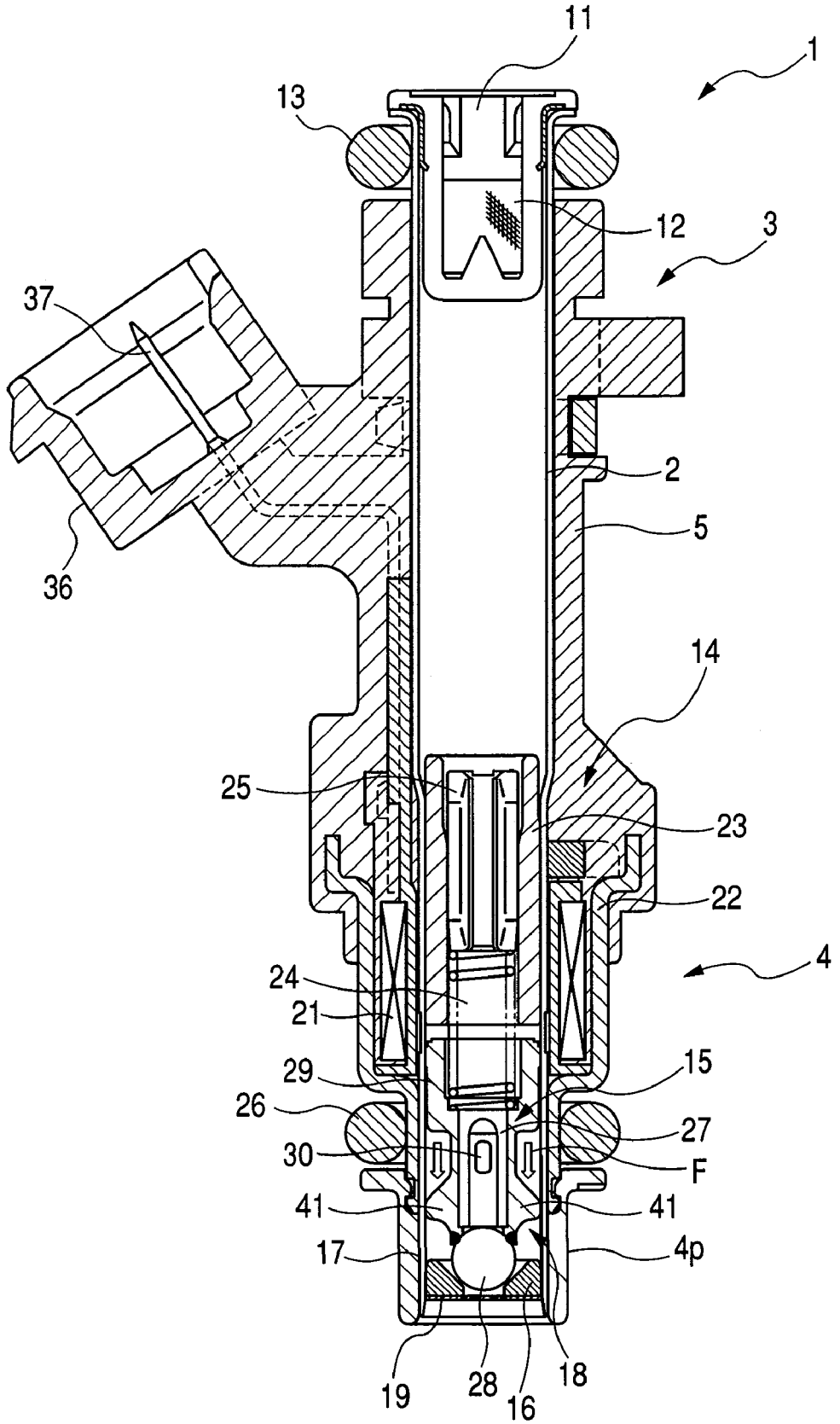
FIG. 1 shows the general structure of a fuel injector according to the first embodiment of the invention.

As mentioned above, flow velocity nonuniformity in the valve circumferential direction attributable to sliding guides is caused by an eddy that occurs in a fuel flow beneath the guide portion. The inventors of the present invention conducted analyses and experiments on such an eddy in fuel flow repeatedly. As a result, it has been found that generation of an eddy of a fuel flow beneath the guide portion can be effectively suppressed by making a flow velocity distribution biased toward the valve surrounding portion provided so as to surround the valve.

The present invention is based on this finding and intended to prevent flow velocity nonuniformity by suppressing generation of an eddy of a fuel flow and thereby prevent the sliding guides from influencing fuel injections from orifices. Concretely, according to one aspect of the invention, in a fuel injector, fuel, flowing down as a valve side flow along a side of a valve, passes through a fuel path which closes and opens as the valve moves forward and backward and further flows down toward an orifice plate; the fuel is then injected as a mist from an orifice made in the orifice plate; the valve moves forward and backward as mentioned above by sliding on a valve surrounding portion which surrounds the valve; and the valve slides thorough a guide portion constituted by a plurality of sliding guides arranged between the valve and the valve surrounding portion. Here, the valve side flow which has passed through the guide portion is made to have a flow velocity distribution biased toward the valve surrounding portion.

The biased flow velocity distribution in the fuel injector is generated by giving the sliding guides a shape for making a biased flow velocity distribution. Regarding such a shape for making a biased flow velocity distribution, it is particularly effective that the sliding guide length in the valve side flow direction gradually decreases from the valve side to the valve surrounding portion side.

According to another aspect of the invention, the fuel injector based on the above finding may be characterized as follows. In the fuel injector, fuel, flowing down as a valve side flow along a side of a valve, passes through a fuel path which closes and opens as the valve moves forward and backward and further flows down toward an orifice plate; the fuel is then injected as a mist from an orifice made in the orifice plate; the valve moves forward and backward as mentioned above by sliding on a valve surrounding portion which surrounds the valve; and the valve slides thorough a guide portion constituted by a plurality of sliding guides arranged between the valve and the valve surrounding portion. Here, the sliding guides are tapered from the valve side toward the valve surrounding portion.

For this fuel injector, preferably the tapering angle of the tapered guide shape should be more acute in lower reaches of the valve side flow than upstream of it; and more preferably the downstream taper line in the tapered guide shape should be a curve convex toward the upper reaches. This enhances the ability to suppress generation of an eddy.

Therefore, according to the present invention, in a fuel injector with sliding guides, the influence of the sliding guides on fuel injections from orifices is more effectively avoided and uniformity in fuel injection and fuel atomization is enhanced.

Figure 2:
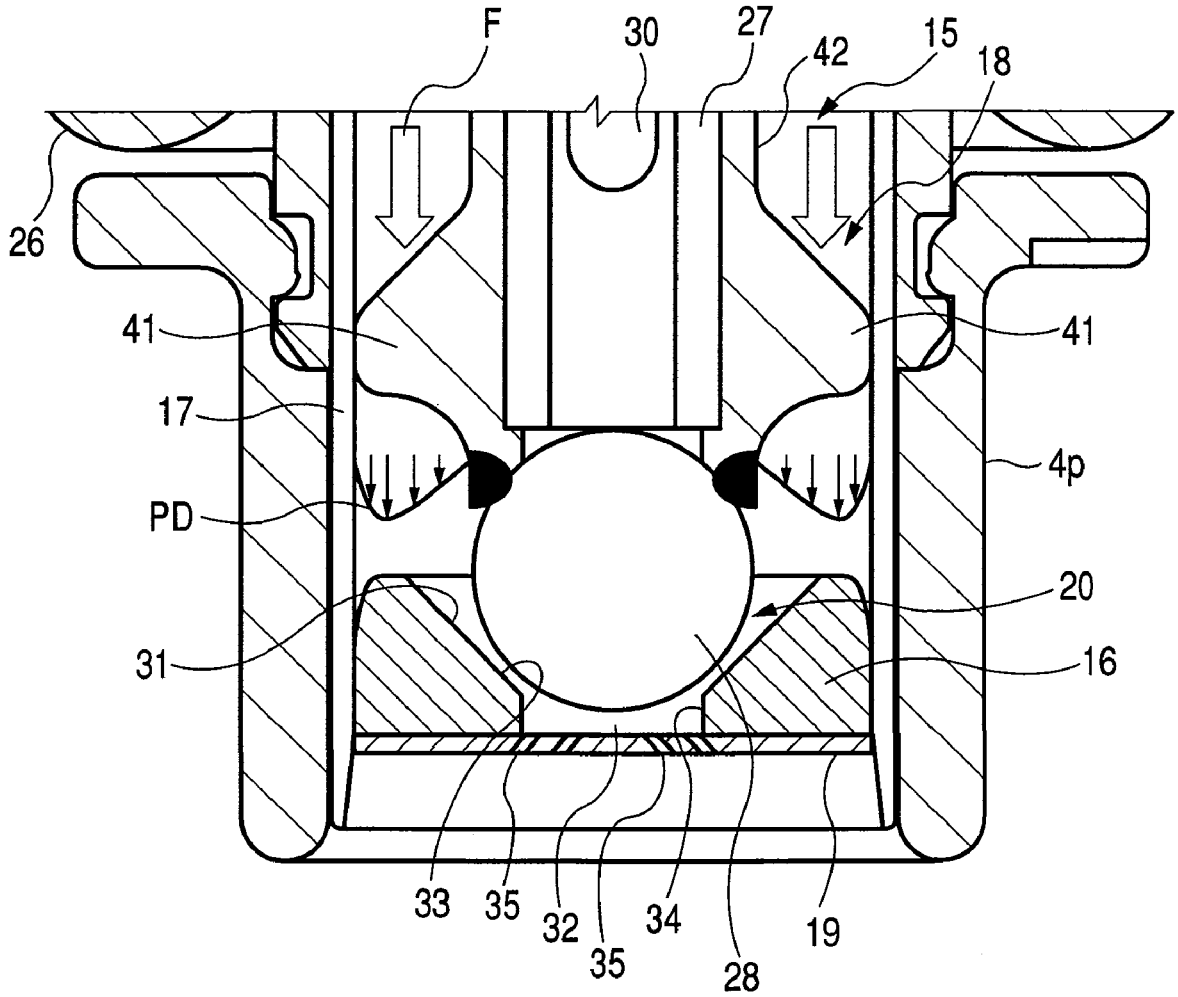
FIG. 2 shows the tip portion of the fuel injector of FIG. 1 in enlarged form.

Next, the preferred embodiments of the present invention will be described. FIG. 1 is a partial sectional view showing the general structure of a fuel injector according to the first embodiment and FIG. 2 shows its tip portion in enlarged form. Referring to FIG. 1, a fuel injector 1 is a multihole injector which is normally closed and used, for example, to supply fuel into an internal combustion engine as a vehicle engine. It includes a casing 2. The casing 2 as a whole is an elongated cylinder produced by press work or cutting. Made of ferrite stainless steel mixed with a flexible material such as titanium, it has a magnetic property.

The casing 2 has a fuel supply portion 3 at its back end side and a fuel injection portion 4 at its tip side. In the fuel injection portion 4, the tip portion of the casing 2 serves as a valve surrounding portion 17 which will be stated later. In the casing 2, the portion between the fuel supply portion 3 and the fuel injection portion 4 is covered with a resin cover 5.

The fuel supply portion 3 includes: a fuel supply port 11 provided at the back end of the casing 2 to allow fuel from outside to flow in; a filter 12 which is provided in lower reaches of the fuel supply port 11 to remove foreign matter from the fuel; and an O ring 13 fitted around the fuel supply port 11 to seal the fuel flowing into the fuel supply port 11.

The fuel injection portion 4 includes a drive mechanism 14, a valve 15, a nozzle body 16, a valve surrounding portion 17, a guide portion 18, and an orifice plate 19 and is covered by a resin cylindrical protector 4*p* for protection.

The drive mechanism 14 electromagnetically moves the valve 15 backward and forward with respect to the nozzle body 16 in order to open or close a fuel path 20 (FIG. 2) formed between the valve 15 and the nozzle body 16. It includes: an electromagnetic coil 21 fitted around the casing 2; a yoke surrounding the electromagnetic coil 21; a cylindrical core 23 which is so positioned inside the casing 2 as to match the electromagnetic coil 21; a spring 24 provided inside the core 23 in away to press the valve 5 toward the tip; a spring adjuster 25 for adjusting the pressure of the spring 24 on the valve 15; and an O ring 26 which is used as a seal at the installation point where the fuel injector 1 is installed in an internal combustion engine.

The valve 15 is of the ball valve type in which a ball 28 is welded to the end of a body portion 27. The body portion 27 as a whole is an elongated hollow bar with an anchor portion 29 at its back end and a fuel hole 30 in its middle. The valve 15 is built in the casing 2 in a manner that when the electromagnetic coil 21 is not live, or in the valve closed state where the ball 28 is seated on (in touch with) the nozzle body 16 under the pressure of the spring 24, there is a given clearance between the back end face of the anchor portion 29 and the front end face of the core 23.

The anchor portion 29, which is formed from magnetic metal powder by a technique such as MIM (Metal Injection Molding), makes up a magnetic circuit together with the yoke 22 and core 23 when an injection pulse current is applied to the electromagnetic coil 21 and thereby works to move the valve 15 backward until the anchor portion 29 is pressed against the core 23 by an attracting force from the core 23.

The ball 28 is a valve action portion which substantially acts as a valve and consists of a metal ball. For example, the metal ball may be a ball bearing steel ball as a JIS product. The ball bearing steel ball as a JIS product has a high degree of roundness and is mirror-finished. Therefore, the use of a ball bearing steel ball as a JIS product offers an advantage that a special process to improve a performance of the seat of the nozzle body 16 is not needed. Besides, a ball bearing steel ball as a JIS product is mass-produced and inexpensive and particularly suitable as a metal ball for the ball 28. The diameter of the ball 28, or the diameter of the metal ball, should preferably be 3-4 mm for the purpose of weight reduction of the valve 15.

The fuel hole 30 enables the fuel flowing through the hollow of the core 23 into the hollow of the valve 15 to flow out into the space surrounding the valve 15 and flow down toward the nozzle body 16 as a valve side flow F, a flow running along the side of the valve 15 in the valve surrounding space.

The nozzle body 16 is made of a metal material hardened by quenching and demagnetized and, as shown in FIG. 2, includes a seat surface 31 and a nozzle hole 32.

The seat surface 31 has a function to establish a valve open state where the fuel path 20 opens or a valve closed state where the fuel path 20 closes, by letting the ball 28 of the valve 15 leave or touch it (the ball is unseated or seated); and the seat surface 31 is inclined at a given angle and formed as a conical surface tapered toward the tip of the nozzle body 16. Regarding the inclination angle, the vertex angle of the conical surface should preferably be within the range of 80-100 degrees and more preferably 90 degrees or so. The inclination angle should be an angle most convenient for polishing the seating point (valve seat position) 33 of the seat surface 31 and its vicinity or for machining to improve the roundness of the seating point 33, namely an angle suitable for the optimal use of a cutting device. Therefore, this seat surface inclination angle largely improves the seatability for the ball 28.

The nozzle hole 32 allows the fuel flowing down through the fuel path 20 after the valve side flow F to flow down toward the orifice plate 19 and allows the falling fuel to turn into a horizontal flow along the orifice plate 19. It is a circular hole with an inner wall surface 34 which is continuous with the seat surface 31 and parallel to the central axis of the fuel injector 1.

The valve surrounding portion 17 forms a valve surrounding space as a flow channel for the valve side flow F by surrounding the valve 15. Also, when the valve 15 moves backward and forward while being guided by the guide portion 18, it slides on the valve surrounding portion 17. As mentioned above, the tip portion of the casing 2 is used as the valve surrounding portion 17.

The guide portion 18 leads the valve 15 to move backward and forward while sliding on the valve surrounding portion 17. The guide portion 18 will be detailed later.

As shown in FIG. 2, the orifice plate 19 takes the shape of a disc which matches the circular front end face of the nozzle body 16. For example, it has a plurality of orifices 35 arranged in a circular pattern concentrically with the nozzle hole 32 with a circular cross section and is welded to the front end face of the nozzle body 16.

The resin cover 5 is formed, for example, by resin molding so as to cover and part of the yoke 22 and part of the casing 2, and has a protruding connector portion 36. A connector 37 for supplying electric power to the electromagnetic coil 21 is provided in the connector portion 36.

The general structure of the fuel injector 1 has been explained so far. The fuel injector 1 is characteristic in the structure of the guide portion 18. Next, the guide portion 18 will be explained in detail.

Figure 3A:
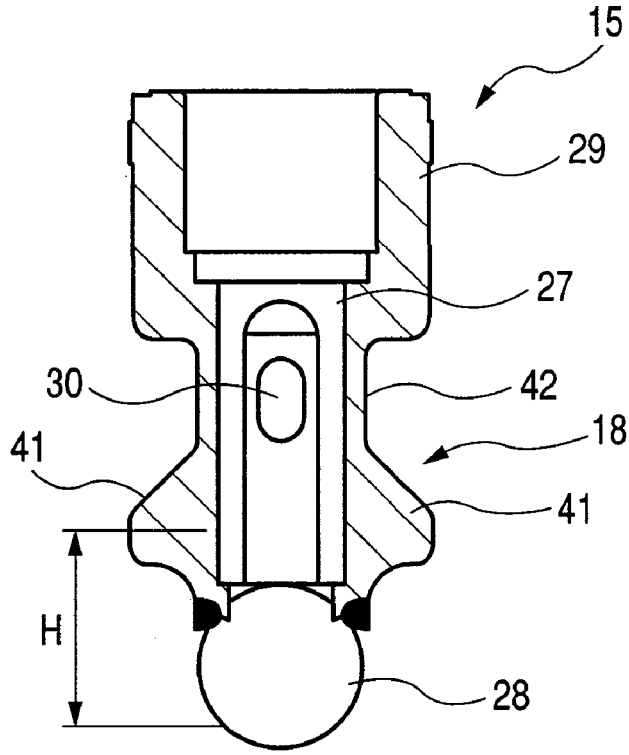
FIGS. 3(*a*) and 3(*b*) show the structure of a valve of the fuel injector of FIG. 1, where FIG. 3(*a*) is a sectional view and FIG. 3(*b*) is a plan view of a guide portion.
Figure 3B:
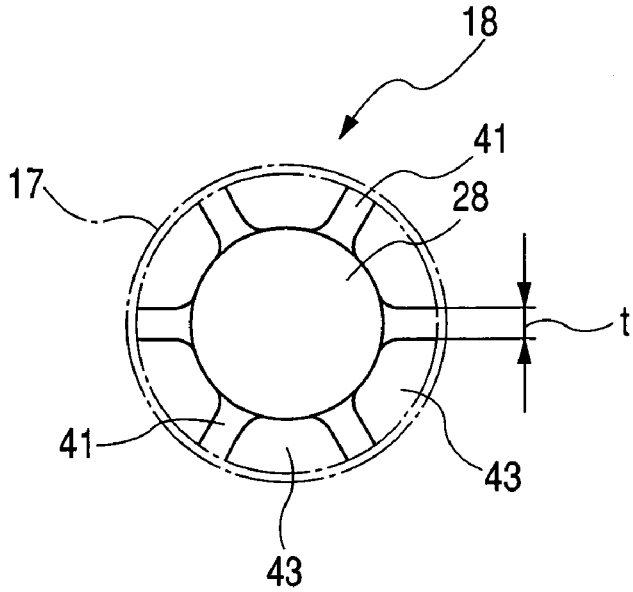

In the guide portion 18, a plurality of sliding guides are arranged between the valve 15 and the valve surrounding portion 17. More specifically, as shown in FIG. 3(*b*), the guide portion 18 comprises a cylindrical guide portion member 42 protruding from the side which has sliding guides 41 like thin flat wing spaced at regular intervals and is attached to the body portion 27 of the valve 15 so as to cover it. The tips of the sliding guides 41 touch and slide on the valve surrounding portion 17. In the guide portion 18 thus structured, the space between neighboring sliding guides 41 serves as a guide flow channel 43 (FIG. 3(*b*)) for the valve side flow F. In this example, the guide portion member 42 is formed integrally with the anchor portion 29 of the valve 15.

The sliding guides 41 of the guide portion 18 influences the valve side flow F when the flow goes through the guide portion 18, or goes down in the guide flow channel 43. Specifically, when the valve side flow F goes down in the guide flow channel 43, friction with the sliding guides 41 occurs, which decreases the flow velocity. For this reason, the valve side flow F is likely to generate an eddy beneath the guide portion 18. Once the eddy occurs, flow velocity nonuniformity in the valve circumferential direction will occur in the fuel flowing down toward the orifice plate 19 and thus fuel injections from the orifices 35 of the orifice plate 19 and fuel atomization conditions will be not uniform.

This problem of nonuniformity is solved by the specific shape of the sliding guides 41. Concretely, the sliding guides are shaped so as to make a biased flow velocity distribution. The shape for making a biased flow velocity distribution is such that the length of each sliding guide 41 in the direction of the valve side flow F gradually decreases from the valve 15 to the valve surrounding portion 17. In other words, the shape for making a biased flow velocity distribution is such that the sliding guide 41 is tapered from the valve 15 to the valve surrounding portion 17 and more preferably, the tapering angle should be more acute in lower reaches of the valve side flow F than in upper reaches of it and still more preferably, the taper line in lower reaches should be convex toward the upper reaches of it. Here, the tapering angle refers to an angle which is formed between a line tangent to the taper line and a line perpendicular to a central axis of the valve 15.

When the sliding guide 41 has such a shape for making a biased flow velocity distribution, a biased flow velocity distribution PD as shown in FIG. 2 is generated in the valve side flow F. The biased flow velocity distribution PD is a flow velocity distribution across the clearance between the valve 15 and the valve surrounding portion 17, namely a flow velocity distribution in a direction perpendicular to the valve circumferential direction. It is expressed by a distribution curve convex toward the lower reaches or curved downward with its peak nearer to the valve surrounding portion 17. This occurs because, due to the tapered guide shape for making a biased flow velocity distribution, the rate of velocity decrease caused by friction with the sliding guide 41 gradually decreases from the valve 15 side to the valve surrounding portion 17.

The biased flow velocity distribution PD effectively prevents the fuel flow from generation of an eddy beneath the guide portion 18 under the influence of the sliding guides 41. Consequently it effectively reduces flow velocity nonuniformity in the valve circumferential direction which might be caused by an eddy as mentioned above. In other words, an unfavorable influence of the sliding guides 41 on fuel injections from the orifices 35 can be effectively avoided, thereby leading to improvement of uniformity in fuel injections from the orifices 35 and fuel atomization conditions.

The area from the lower end of each sliding guide 41 to the seating point 33 may be considered as an inlet zone in which the fuel which has passed through the guide portion 18 flows into the nozzle hole 32 toward the orifice plate 19. A length of the inlet zone, or an approach length, affects the atomization level of fuel injected from each orifice 35: the longer the approach length is, the higher the atomization level is. On the other hand, the approach length determines installation height H (FIG. 3(*a*)) of the sliding guide 41. Installation height H affects the stability in forward/backward movement of the valve 15: as the installation height is larger, the stability in forward/backward movement is lower and side oscillation is more likely to occur. The atomization level is also affected by the number of sliding guides 41: as the number of sliding guides 41 is larger, the atomization level is lower and thus the approach length required to attain a desired particle size is larger. On the other hand, the number of sliding guides 41 affects the stability in forward/backward movement of the valve 15: the larger the number of sliding guides 41 is, the higher the stability in forward/backward movement is.

Figure 4:
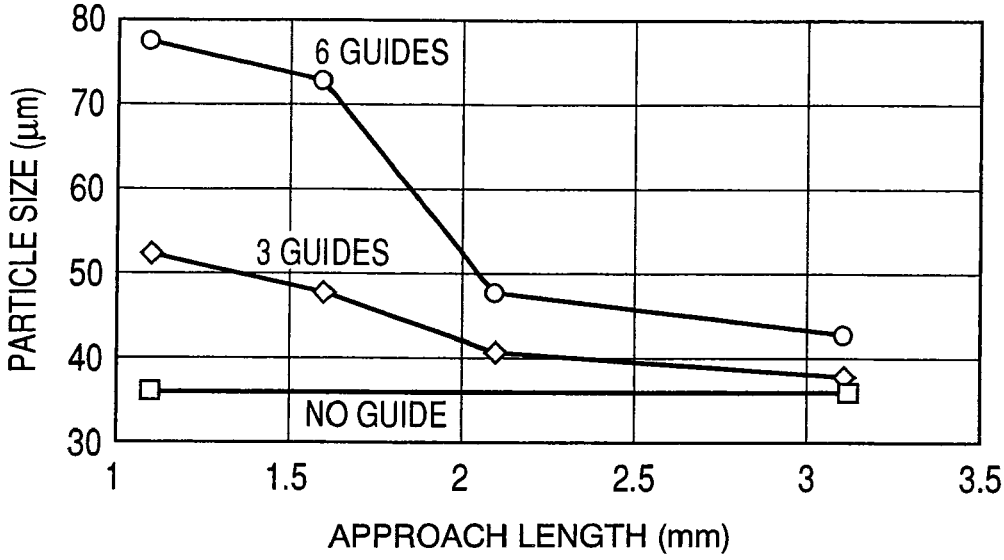
FIG. 4 is a graph showing the relation between the number of sliding guides and approach length.

FIG. 4 shows the result of an experiment on the relation between approach length and the number of sliding guides. In the experiment, installation height H was the same among the sliding guides. This means that if the number of sliding guides is 6, the six sliding guides have the same installation height. The valve size was the same as that of a standard fuel injector and the sliding guide thickness (t as shown in FIG. 3(*b*)) was 0.68 mm.

As can be understood from the experimental result, if the desired particle size is 50 μm, the approach length required to attain this is approximately 1.5 mm or more in case of using three guides and approximately 2.1 mm or more in case of using six guides. Another experiment has demonstrated that three or more sliding guides must be installed for stable forward/backward movement of the valve and the most desirable number of guides is 6 or so. From these results, the desirable range of the ratio of approach length L to sliding guide thickness t, which affects the possibility of flow velocity nonuniformity in the valve circumferential direction, is expressed by L/t=2–20.

The structure of the fuel injector 1 in the first embodiment has been explained so far. Next, how the fuel injector 1 works will be explained. When the electromagnetic coil 21 is not live, the ball 28 of the valve 15 is seated on (in close contact with) the seat surface 31 of the nozzle body 16 at the seating point 33 under the force of the spring 24, thereby reaching the valve closed state. In this valve closed state, the fuel path 20 between the ball 28 of the valve 15 and the nozzle body 16 is not open and the fuel which has come from the fuel supply port 11 stays inside the casing 2.

When an injection pulse current is applied to the electromagnetic coil 21 in this state, the anchor portion 29 makes up a magnetic circuit together with the yoke 22 and core 23 and thus the anchor portion 29 receives an attracting force from the core 23, which moves the valve 15 backward until the anchor portion 29 is pressed against the core 23; consequently the valve 15 becomes unseated on the nozzle body 16, reaching the valve open state. In the valve open state, the fuel path 20 is open. Thus, fuel flows into the space surrounding the valve 15 from the fuel hole 30 and goes down as valve side flow F and passes through the guide portion 18; after passing through the guide portion 18, the fuel flow becomes a flow with a biased flow velocity distribution PD and the fuel further goes down through the fuel path 20 toward the orifice plate 19. The fuel which has flown down to the orifice plate 19 turns into a horizontal flow along the orifice plate 19 as mentioned above which is then injected as a mist from each orifice 35. The fuel injections from the orifices 35 are highly uniform in terms of fuel injection and atomization conditions as mentioned above. In this case, the fuel injection rate is controlled by adjusting the application timing for injection pulses to be applied to the electromagnetic coil 21 intermittently, namely the timing for switching between the valve open state and the valve closed state.

Figure 5:
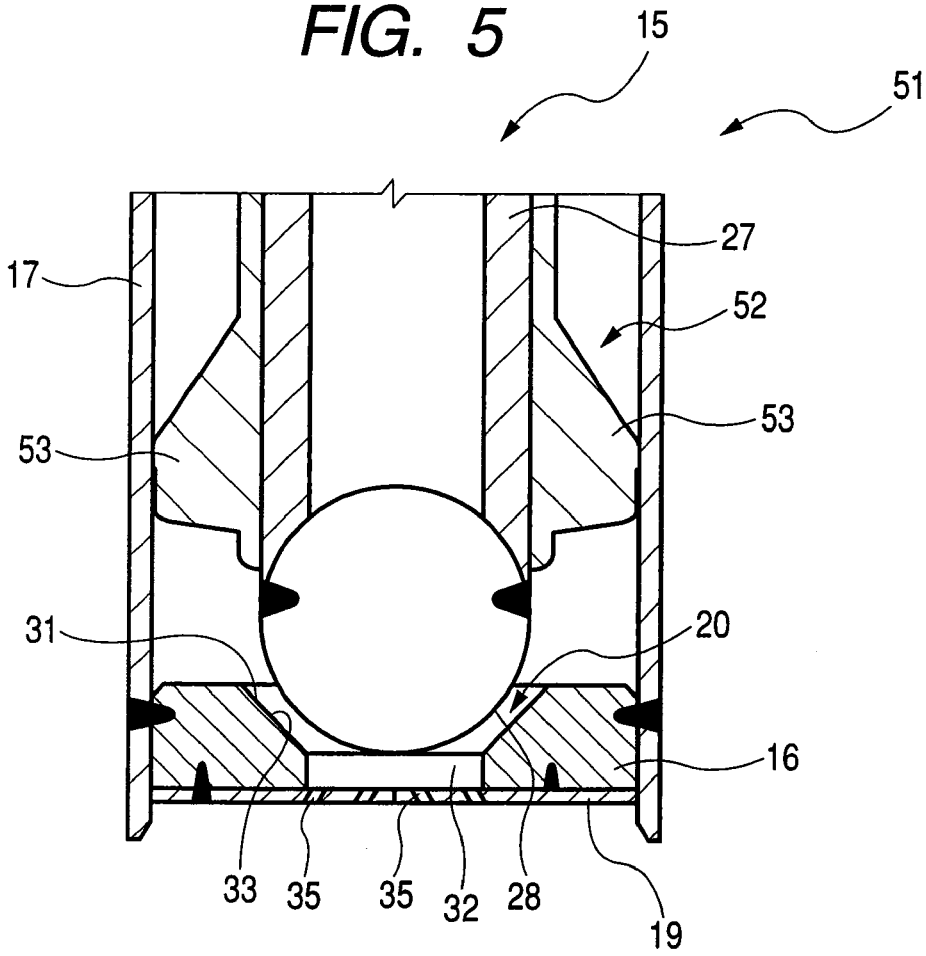
FIG. 5 shows the structure of a key part of a fuel injector according to the second embodiment of the invention.

Next, the second embodiment of the invention will be described. FIG. 5 is a partial sectional view showing the structure of a key part of a fuel injector according to the second embodiment. The fuel injector 51 in this embodiment is different from the fuel injector 1 in the first embodiment in the way the guide portion 52 is installed. While in the first embodiment the separate guide portion member 42 is attached to the body portion 27 of the valve 15 to form the guide portion 18, in the second embodiment sliding guides 53 are integral with the body portion 27 of the valve 15. In order to make the sliding guides 53 integral with the body portion 27, a machining method whereby the valve material is cut to form a valve and sliding guides integrally may be used or the member shaped as sliding guides 53 may be integrally welded to the body portion 27. The rest of the structure is basically the same as in the first embodiment and the same elements are designated by the same reference numerals shown in FIG. 1 and their descriptions are omitted here.

Figure 6:
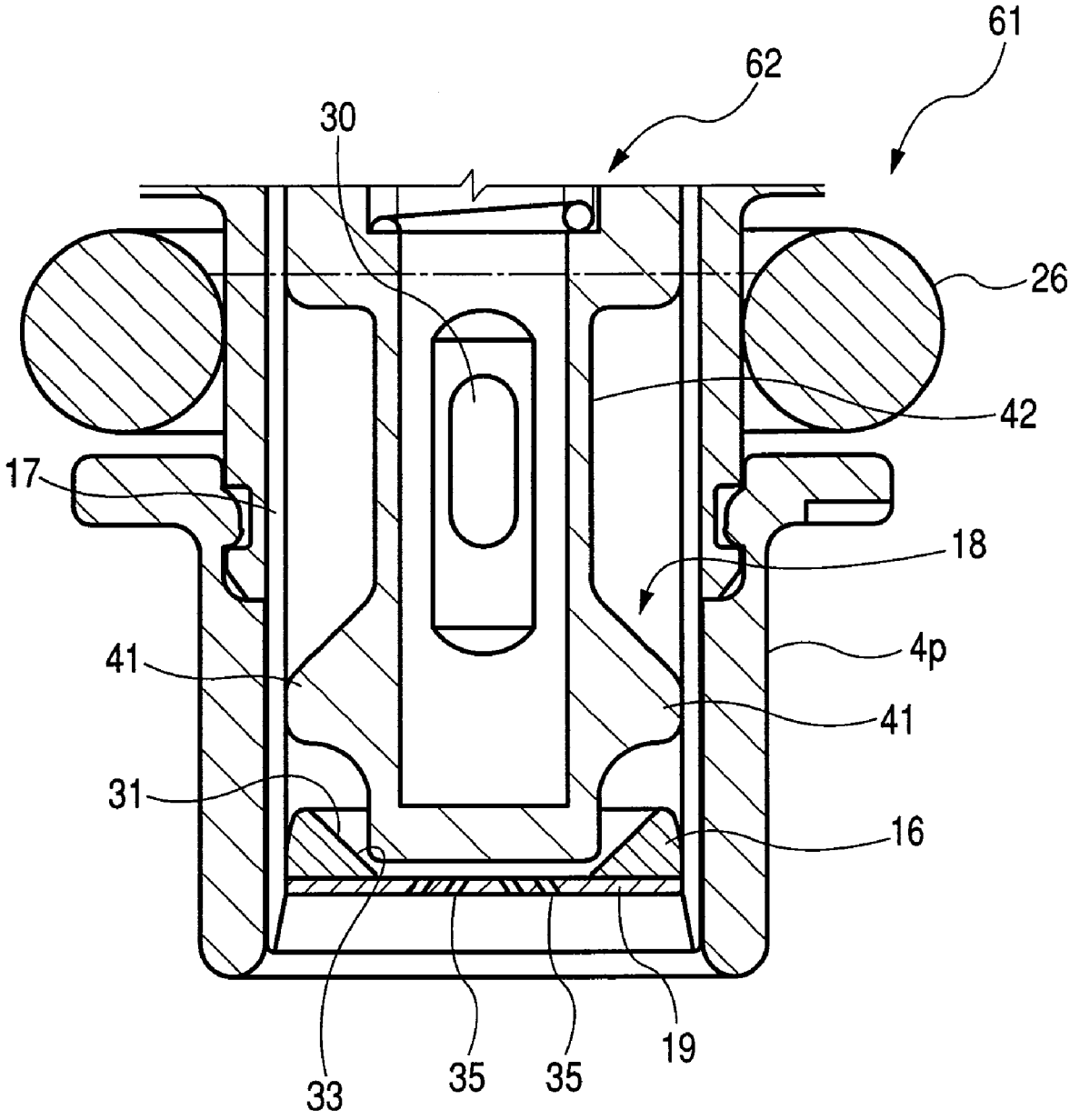
FIG. 6 shows the structure of a key part of a fuel injector according to the third embodiment of the invention.

Next, the third embodiment of the invention will be described. FIG. 6 is a partial sectional view showing the structure of a key part of a fuel injector according to the third embodiment. The fuel injector 61 in this embodiment is different from the fuel injector 1 in the first embodiment in the structure of a valve 62. The valve 62 is of the non-ball valve type and has the same structure as that of the first embodiment except that the ball 28 is removed from the valve 15. This structure offers an advantage that the number of components is smaller. The rest of the structure is basically the same as in the first embodiment and the same elements are designated by the same reference numerals shown in FIG. 1 and their descriptions are omitted here.

Figure 7A:
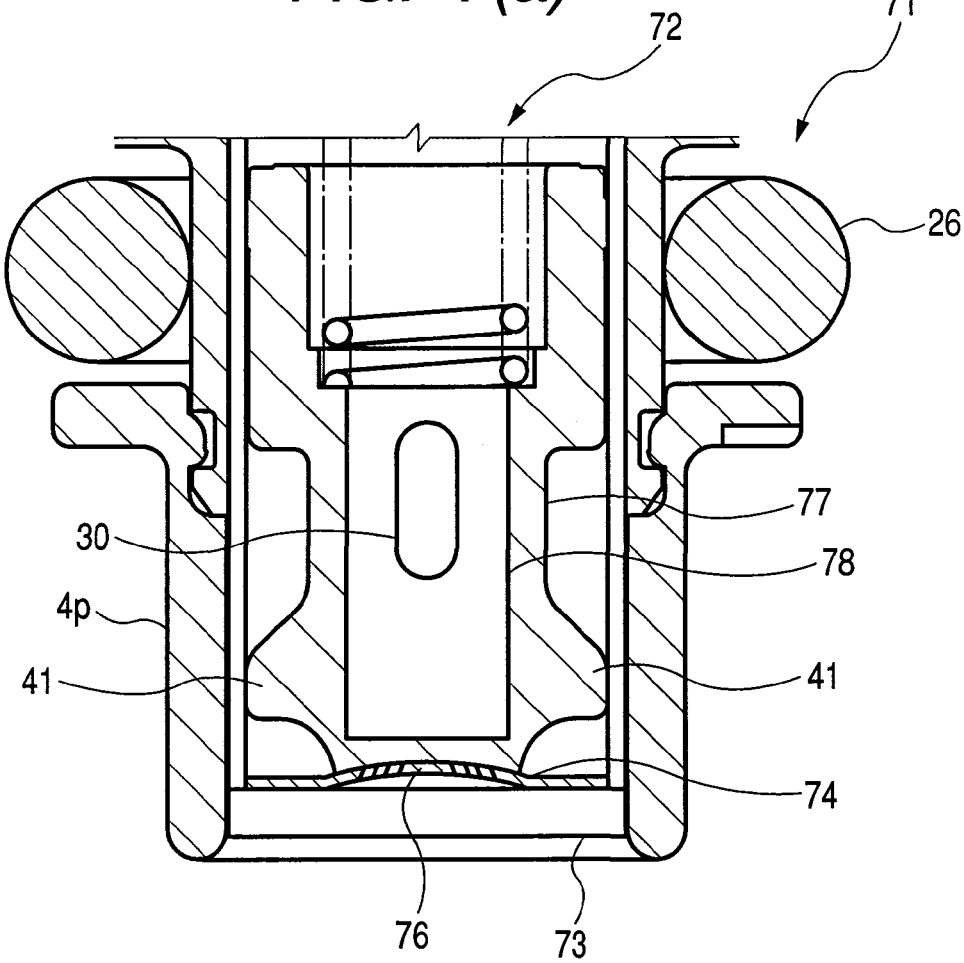
FIGS. 7(*a*) and 7(*b*) show the structure of a key part of a fuel injector according to the fourth embodiment of the invention, where FIG. 7(*a*) shows a valve closed state and FIG. 7(*b*) shows a valve open state in enlarged form.
Figure 7B:
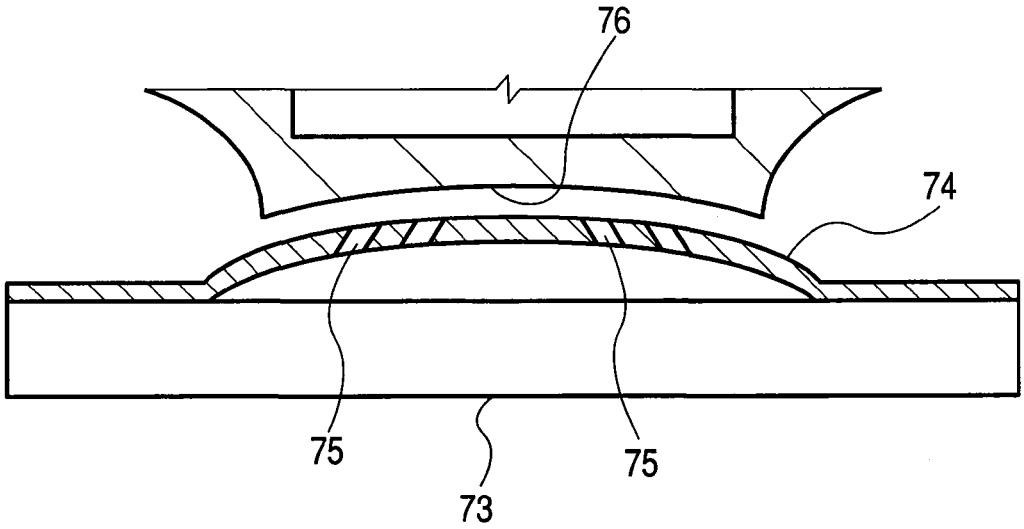

Next, the fourth embodiment of the invention will be described. FIGS. 7(*a*) and 7(*b*) are partial sectional views showing the structure of a key part of a fuel injector according to the fourth embodiment. In the fuel injector 71 in this embodiment, as a non-ball valve type valve 72 directly leaves or touches an orifice plate 73, a valve open state or a valve closed state is produced. Specifically, as shown in FIG. 7(*b*), an enlarged view of the part concerned, the orifice plate 73 has a seat receiving surface 74 as a partially spherical convex surface in which there are a plurality of orifices 75. On the other hand, the valve 72 has, at its tip, a concave seat surface portion 76 which fits the convex seat receiving surface 74 complementarily. More specifically, the seat surface portion 76 is provided on the valve 72 as follows: the seat surface portion 76 is formed on a guide portion member 77 which is equivalent to the guide portion member 42 in the first embodiment and the guide portion member 77 is put over the body portion 78 of the valve 72.

The valve 72 and the orifice plate 73 function to close or open the valve as follows: as the valve 72 moves forward, the seat surface portion 76 closely contacts the seat receiving surface 74, producing a valve closed state (FIG. 7(*a*)) and as the valve 72 moves backward, the seat surface portion 76 leaves the seat receiving surface 74, producing a valve closed state (FIG. 7(*b*)).

For the purpose of decreasing the number of components, it is advantageous that the orifice plate 73 also functions as a valve opening/closing seat in this way. In addition, the nozzle body 16 in the first embodiment is omitted and therefore the distance of downflow for a horizontal fuel flow along the orifice plate 73 is increased, thereby offering an advantage that injected fuel is more atomized. The rest of the structure is basically the same as in the first embodiment and the same elements are designated by the same reference numerals shown in FIG. 1 and their descriptions are omitted here.

So far several preferred embodiments of the invention have been described; however, they are just typical ones among many and the invention may be embodied in other various forms without departing from the spirit and scope thereof. For instance, although sliding guides are provided on the valve in the first to fourth embodiments, instead sliding guides may be provided on the valve surrounding portion. Furthermore, although in the above embodiments plural sliding guides are installed at the same height, the invention is not limited thereto. It is also possible that the guide portion comprises sliding guides installed at different heights: for example, if six sliding guides are provided, three of them are installed at height Ha and the other three are installed at height Hb.

What is claimed is:

1. A fuel injector, which comprises:

a fuel injection portion comprising:

a drive mechanism inserted into a casing for driving a valve body to move the valve body backward and forward, a nozzle body having a nozzle hole, a valve surrounding portion for surrounding the valve body, a guide portion having a plurality of sliding guides each extending in a radial direction from the valve body, which has a fuel hole, an orifice plate having an orifice, the valve body being slidably inserted into the casing for closing and opening a fuel path formed between the valve surrounding portion and the valve body and formed through the sliding guides by letting a valve tip of the valve body contact with and separate from the nozzle body; and the casing covering the fuel injection portion, wherein the sliding guides connected to the valve body at a lower point of the fuel path, being slidably inserted into the casing, and wherein the sliding guides form a biased flow velocity distribution after the sliding guides, the biased flow velocity distribution having a maximum value biased towards a valve surrounding portion side.

2. The fuel injector according to claim 1, wherein each of the sliding guides has a shape tapering along a taper line from a valve body side to the valve surrounding portion to thereby give a thickness at its valve body side larger than that at the valve surrounding portion side.

3. The fuel injector according to claim 2, wherein a tapering angle of the sliding guides is more acute in lower reaches of the valve body side than in upper reaches, where the tapering angle is to an angle formed between a line tangent to the taper line and a line perpendicular to a central axis of the valve body.

4. The fuel injector according to claim 2, wherein the taper line in lower reaches is convex towards upper reaches.

* * * * *